US008172420B2

(12) United States Patent
Lovinger

(10) Patent No.: US 8,172,420 B2
(45) Date of Patent: May 8, 2012

(54) MODULAR LIGHTING SYSTEM

(76) Inventor: Mark Lovinger, Riverside, CA (US)

( * ) Notice: Subject to any disclaimer, the term of this patent is extended or adjusted under 35 U.S.C. 154(b) by 301 days.

(21) Appl. No.: 12/533,856

(22) Filed: Jul. 31, 2009

(65) Prior Publication Data

US 2010/0027239 A1 Feb. 4, 2010

Related U.S. Application Data

(60) Provisional application No. 61/085,372, filed on Jul. 31, 2008.

(51) Int. Cl.
*F21V 21/00* (2006.01)

(52) U.S. Cl. ..... 362/217.16; 362/217.05; 362/217.15

(58) Field of Classification Search ..... 362/217.05, 362/217.15, 217.16, 221, 225, 217.17
See application file for complete search history.

(56) References Cited

U.S. PATENT DOCUMENTS 4,316,121 A * 2/1982 Hammer et al. ..... 315/62
4,435,744 A * 3/1984 Russo ..... 362/219
5,088,015 A * 2/1992 Baggio et al. ..... 362/657

* cited by examiner

*Primary Examiner* — John A Ward
(74) *Attorney, Agent, or Firm* — Christie, Parker & Hale, LLP

(57) ABSTRACT

A luminaire, light fixture base, and self-ballasting fluorescent lighting stick are disclosed. The luminaire includes a fixture base and self-ballasted fluorescent lighting sticks. The fixture base is configured to secure the lighting sticks, and to provide electrical power to the lighting sticks at an electrical end of the fixture base. Each of the lighting sticks is separately replaceable in the fixture base. The electrical end of the fixture base includes electrical connectors that mate with corresponding electrical connectors of the lighting sticks. The light fixture base is configured to secure and pass electrical power to a self-ballasted fluorescent lighting stick. The light fixture base includes an electrical end section, a securing end section, and a middle section. The self-ballasted fluorescent lighting stick is configured to secure and pass electrical power to a fluorescent bulb. The fluorescent lighting stick includes a ballast circuit, electrical wiring, an electrical connector, and a frame.

39 Claims, 5 Drawing Sheets

MODULAR LIGHTING SYSTEM

CROSS-REFERENCE TO RELATED APPLICATION(S)

This application claims priority to and the benefit of U.S. Provisional Application No. 61/085,372, entitled "Modular Lighting System," filed Jul. 31, 2008, the entire content of which is incorporated by reference herein.

BACKGROUND OF THE INVENTION

1. Technical Field

This invention relates to lighting systems. Specifically, the invention refers to modular lighting systems with separately replaceable lighting elements.

2. Related Art

Fluorescent lighting has been widely used for decades. A fluorescent luminaire is typically organized as a separate fixture into which one or more lamps are mounted. A fixture base provides for mechanical mounting and often provides light reflectors to direct light in desired directions. These fixtures are commonly mounted on, mounted within, or suspended from ceilings. Ballast circuits needed for fluorescent light operation are typically part of the fixture base and permanently mounted to an inaccessible area of the fixture base. Fluorescent lamps are generally cylindrical and are commonly referred to as tubes or bulbs.

Common luminaires provide wiring to power the lamps and ballast circuit. Although circuit details vary, depending primarily on the ballast circuit, an electrical mains supply, typically 110 or 220 volts, is routed to the ballast and lamp. Fixtures with multiple lamps are typically configured to use one ballast circuit for all of the bulbs.

Prior fluorescent lighting systems, particularly those with a single ballast and multiple bulbs, have some limiting traits:

- Component failures are not isolated.
  - Failure of one bulb will often prevent proper operation of other bulbs in the fixture because the bulbs electrically interact through the shared ballast.
  - Failure of the single ballast circuit will prevent operation of any of the bulbs in the fixture.
  - Failure of the ballast circuit is often repaired by replacement of the entire fixture.
- The bulbs must be operated in an all or none manner.
- The ballast and bulbs may operate inefficiently. It may be necessary to change ballast circuits to fully utilize improved bulbs, and vice versa.

SUMMARY OF THE INVENTION

One or more embodiments of the present invention address the above issues and can provide additional benefits. As shown in the FIGS. 1 and 2, in one embodiment, a fixture locates the ballast in a replaceable unit 10 with the bulb 12. This is unlike the common system that places the ballast with a fixture base. The shown fixture base 20 holds two self-ballasted stick lights 10. FIG. 1 shows the stick lights above and at an angle to their operational location in the fixture. FIG. 2 shows the fixture with the sticks lights 10 installed.

In one exemplary embodiment according to the present invention, a luminaire is provided. The luminaire includes a fixture base and one or more self-ballasted fluorescent lighting sticks. The fixture base is adapted to secure the lighting sticks. The fixture base is configured to pass electrical power to the lighting sticks at an electrical end of the fixture base. Each of the lighting sticks is separately replaceable in the fixture base. Each of the lighting sticks is configured to secure and pass electrical power to a fluorescent bulb. Each of the lighting sticks includes a ballast circuit, electrical wiring, an electrical connector, and a frame. The electrical connector is configured at an electrical end of the lighting stick. The frame is configured to retain the fluorescent bulb, the ballast circuit, the electrical wiring, and the electrical connector. The electrical end of the fixture base includes a mating connector for the electrical connector of each of the lighting sticks, and electrical wiring configured to pass electrical power to the electrical end of each of the lighting sticks.

In another exemplary embodiment according to the present invention, a light fixture base is provided. The light figure base is configured to secure and pass electrical power to a separately replaceable self-ballasted fluorescent lighting stick. The fluorescent lighting stick includes a fluorescent bulb, a ballast circuit, electrical wiring, an electrical connector, and a frame. The electrical connector is configured at an electrical end of the lighting stick. The frame is configured to retain the fluorescent bulb, the ballast circuit, the electrical wiring, and the electrical connector. The light fixture base includes an electrical end section, a securing end section, and a middle section. The electrical end section includes a mating electrical connector for the electrical connector of the lighting stick, electrical wiring, and an International Electrotechnical Commission (IEC) 60320 connector. The electrical wiring is configured to pass electrical power to the electrical end of the lighting stick. The IEC 60320 connector is configured for passing mains power to the light fixture base. The securing end section is adapted to secure the lighting stick to the light fixture base. The middle section is adapted to have a length that corresponds to the length of the fluorescent bulb. The middle section is configured to establish mechanical alignment of the electrical end section and the securing end section.

Another exemplary embodiment according to the present invention provides a self-ballasted fluorescent lighting stick. The fluorescent lighting stick is configured to secure and pass electrical power to a fluorescent bulb. The fluorescent lighting stick includes a ballast circuit, electrical wiring, an electrical connector, and a frame. The electrical connector is configured at an electrical end of the fluorescent lighting stick. The frame is configured to retain the fluorescent bulb, the ballast circuit, the electrical wiring, and the electrical connector. The fluorescent lighting stick is configured to be secured in and receive electrical power from a light fixture base. The light fixture base includes an electrical end. The electrical end of the light fixture base includes a mating electrical connector for the electrical connector of the fluorescent lighting stick.

BRIEF DESCRIPTION OF THE DRAWINGS

The accompanying drawings illustrate embodiments of the present invention, and together with the description, serve to explain the principles of the embodiments of the present invention.

DETAILED DESCRIPTION

Now, exemplary embodiments of the present invention will be described in more detail with reference to the accompanying drawings.

Figure 1:
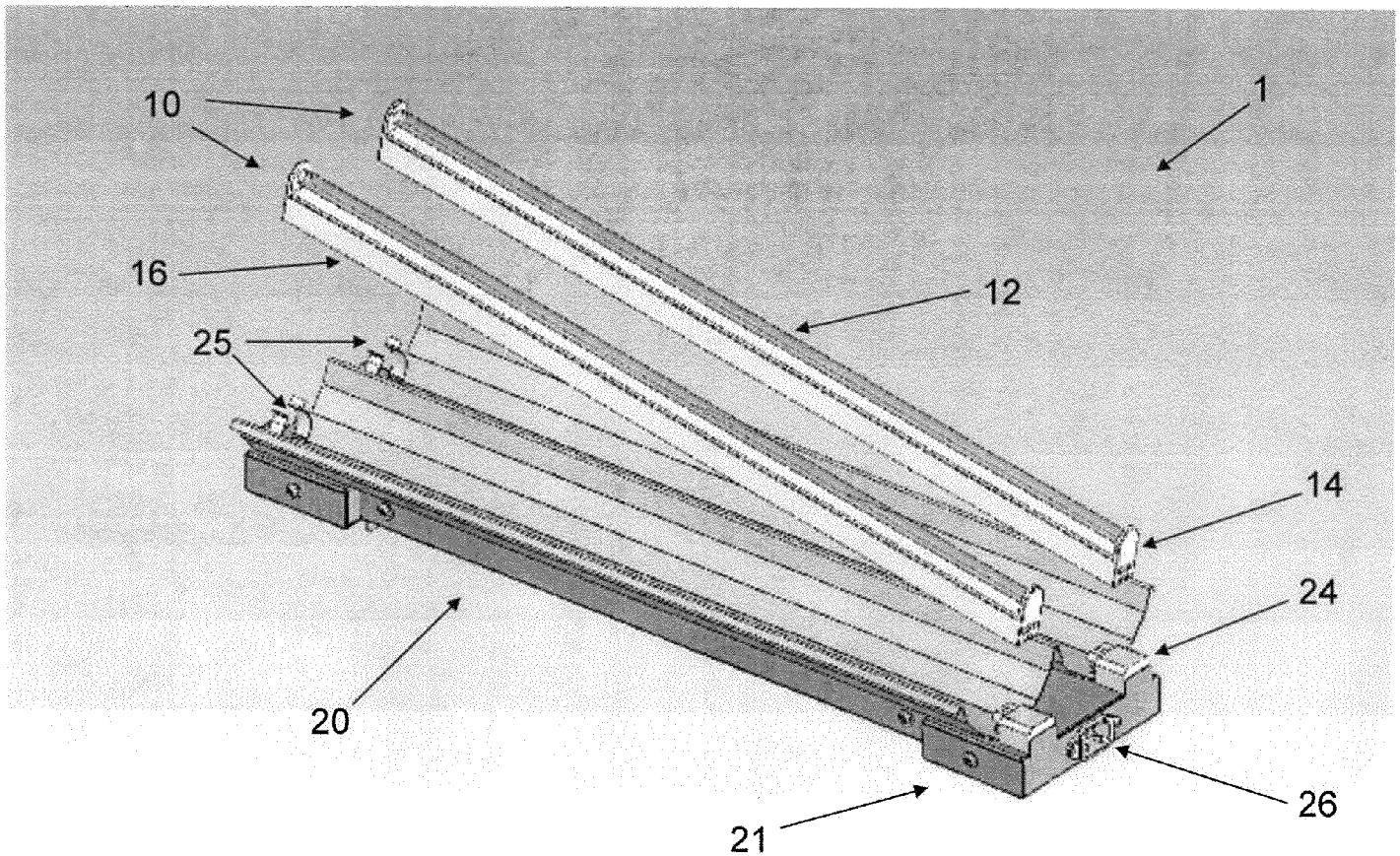
FIG. 1 is an oblique view of an exemplary embodiment of the present invention, illustrating the separately replaceable stick lights above and at an angle to their operational location in the fixture.

Referring now to FIG. 1, in an exemplary embodiment of the present invention, a lighting fixture 1, including two stick lights 10, is shown. Each stick light 10 includes a fluorescent bulb 12, a ballast circuit, an electrical connector 14 at an electrical end of the light stick, a switch, electrical wiring, and a thin frame 16 that retains the components and allows attachment to a fixture base 20. The fluorescent bulb may be of a T5 size. The electrical connector 14 on the stick light 10 connects to a corresponding electrical connector 24 on the fixture base 20 (at an electrical end 21 of the fixture base). Since the electrical connections are located at one end (the electrical end) of the stick light, the corresponding end of the fixture (that is, the electrical end 21) is electrically wired to supply power. For example, in FIG. 1, an International Electrotechnical Commission (IEC) 60320 connector 26 delivers mains power to the fixture base 20 at the electrical end 21 of the fixture base. Open spring type clamps 25 at another end of the fixture base help secure the stick lights 10 to the fixture base 20.

Figure 2:
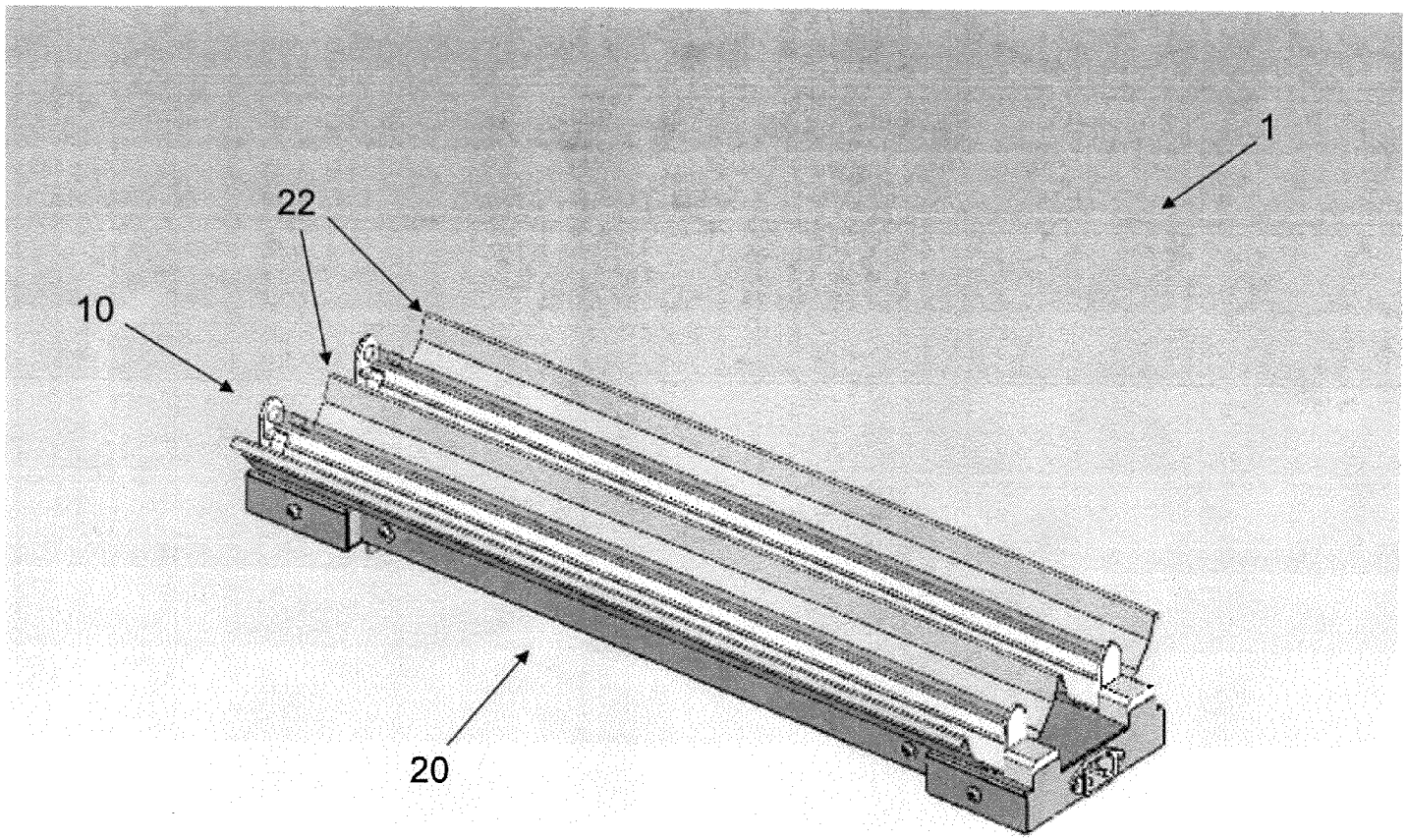
FIG. 2 is the same as FIG. 1, only with the stick lights installed.

FIG. 2 shows the lighting fixture 1 of FIG. 1, only with the stick lights 10 installed in the fixture base 20. The fixture base in this embodiment has reflectors 22 for directing the light produced by the stick lights 10.

The lighting system provides enhancements over conventional systems:

Relocation of the ballast circuit creates a light fixture that isolates component failures. A point failure in a ballast circuit or in a bulb will only affect that lamp.

The bulbs and ballast may be advantageously adapted to effectively utilize the specific characteristics of each.

Individual bulbs may operate independently when the stick lights include a switch.

Figure 3:
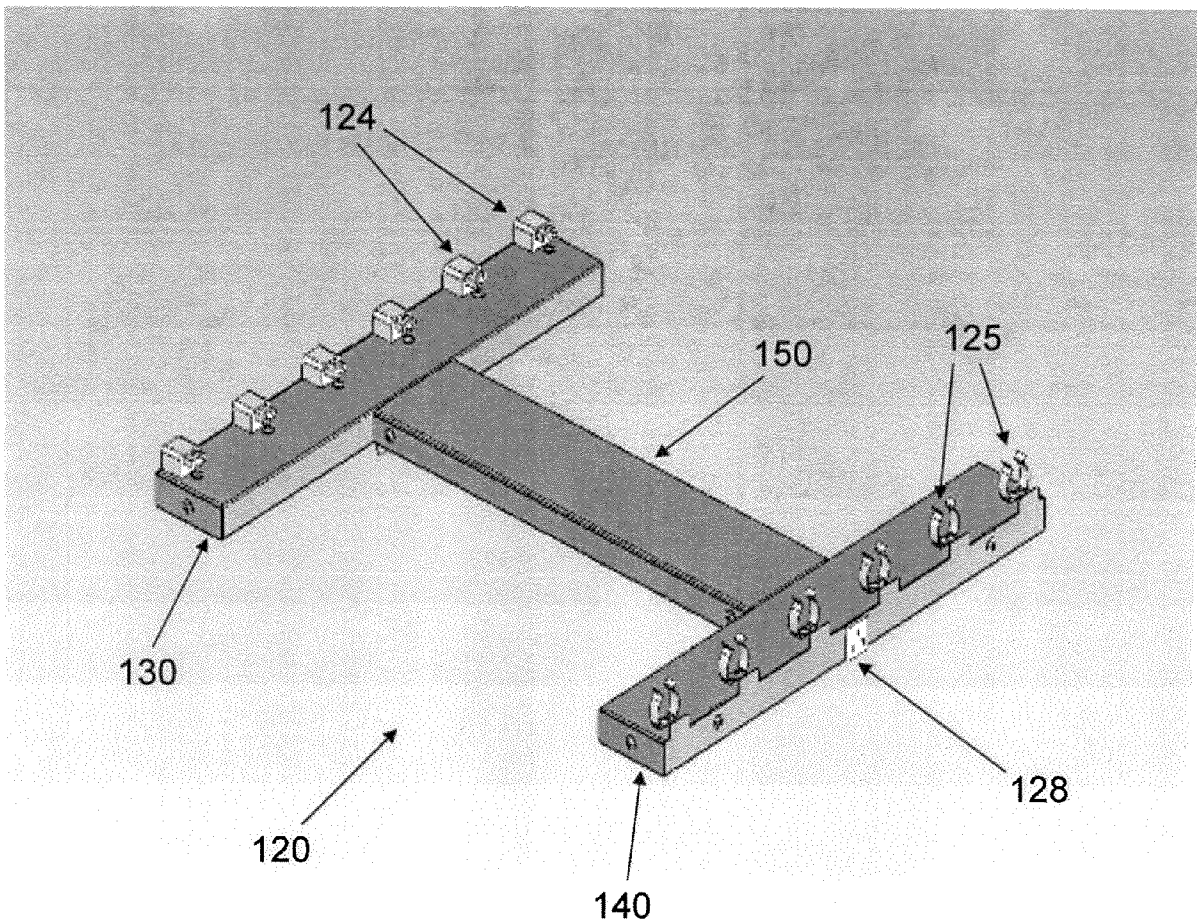
FIG. 3 depicts an oblique view of a fixture base according to an exemplary embodiment of the present invention.

A fixture base 120 according to another exemplary embodiment of the present invention is shown in FIG. 3. The fixture shown is without light reflectors. The fixture base includes three sections: two end sections 130 and 140, and a middle section 150. Electrical end section 130 corresponds to the electrical end of the fixture base 120 and passes power to the stick lights' electrical connectors through corresponding mating electrical connectors 124. Securing end section 140 helps to secure the stick lights using open spring type clamps 125. The sections may be formed of sheet metal bent to the desired shape. Other manufacturing methods and materials are also suitable, for example, molding and plastic.

Figure 4:
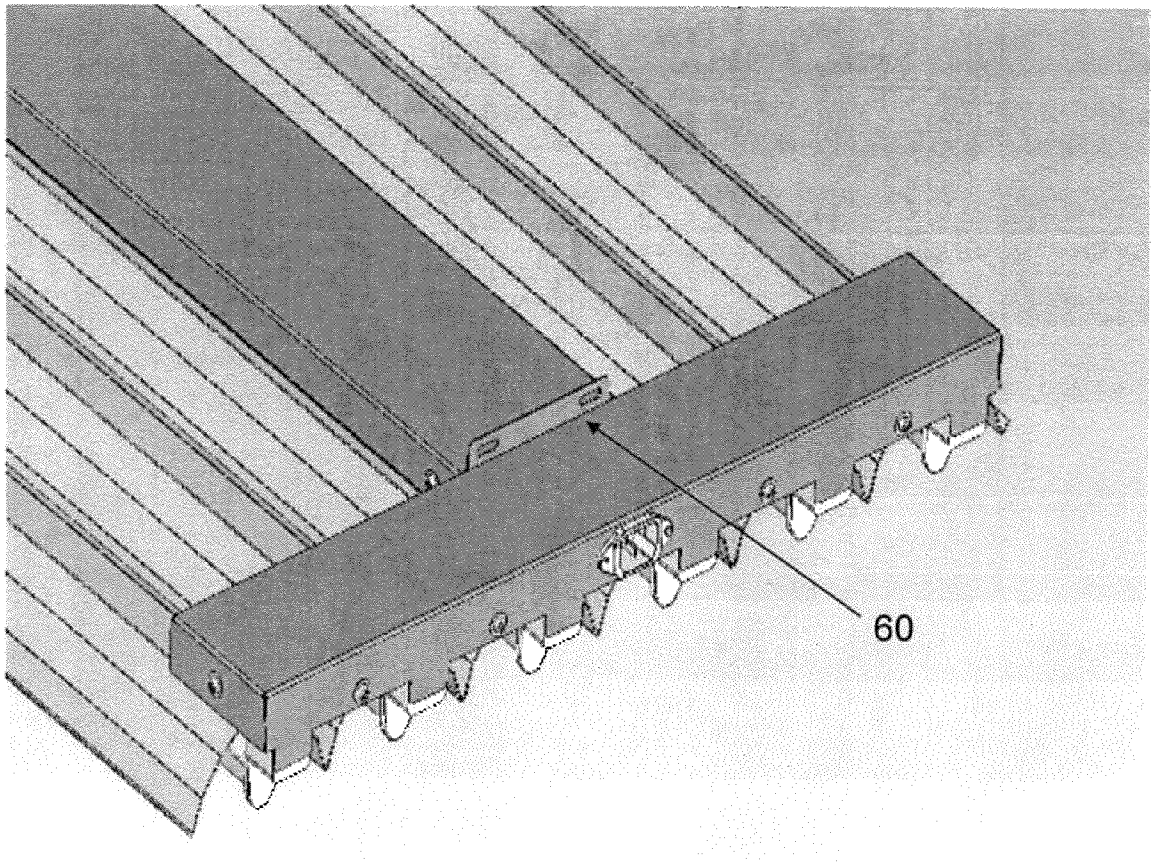
FIG. 4 depicts an underside oblique view of a fixture base according to an exemplary embodiment of the present invention.

In some embodiments, the fixture sections are assembled with tabs and slots in a snap-together manner. This may be useful to reduce the size required for shipping or storage. The sections may alternatively be assembled with fasteners, for example, screws or rivets. Other embodiments may weld or glue the sections together. The fixture sections are shown with a closed box shape but may alternatively be open or rounded. The sections generally include tabs and slots for mounting as shown, for example, by element 60 in FIG. 4. FIG. 4 depicts an underside of a mounting base according to an exemplary embodiment of the present invention.

The fixture section to which the electrical end of a stick light connects is wired to pass mains power to the lamps. Some embodiments provide additional IEC 60320 electrical connectors that may be used for wiring to additional fixtures or for convenience powering. See, for example, connector 128 in FIG. 3, located at the securing end section 140 of fixture base 120. In some embodiments of the invention, wiring is required within only one end section of the fixture. In contrast, conventional fixtures have wires throughout the fixture as required because the fluorescent tubes they use have connections at both ends.

The luminaire will generally be powered by common AC power. The voltage will generally be about 110 volts or about 220 volts. The voltage usually depends on the country of use. Wiring of the fixture does not depend on the voltage used. A fixture's wiring need only provide an electrical power connection for the stick lights. Thus, in an embodiment of the invention, the same fixture can be used with different voltages.

Both end sections of the fixture are similar in shape and size. However, the ends are adapted to the corresponding end of a stick light. The non-electrical end is adapted to physically restrain stick lights. Open spring type clamps are shown in the figures, but other holding arrangements may be used.

Figure 5:
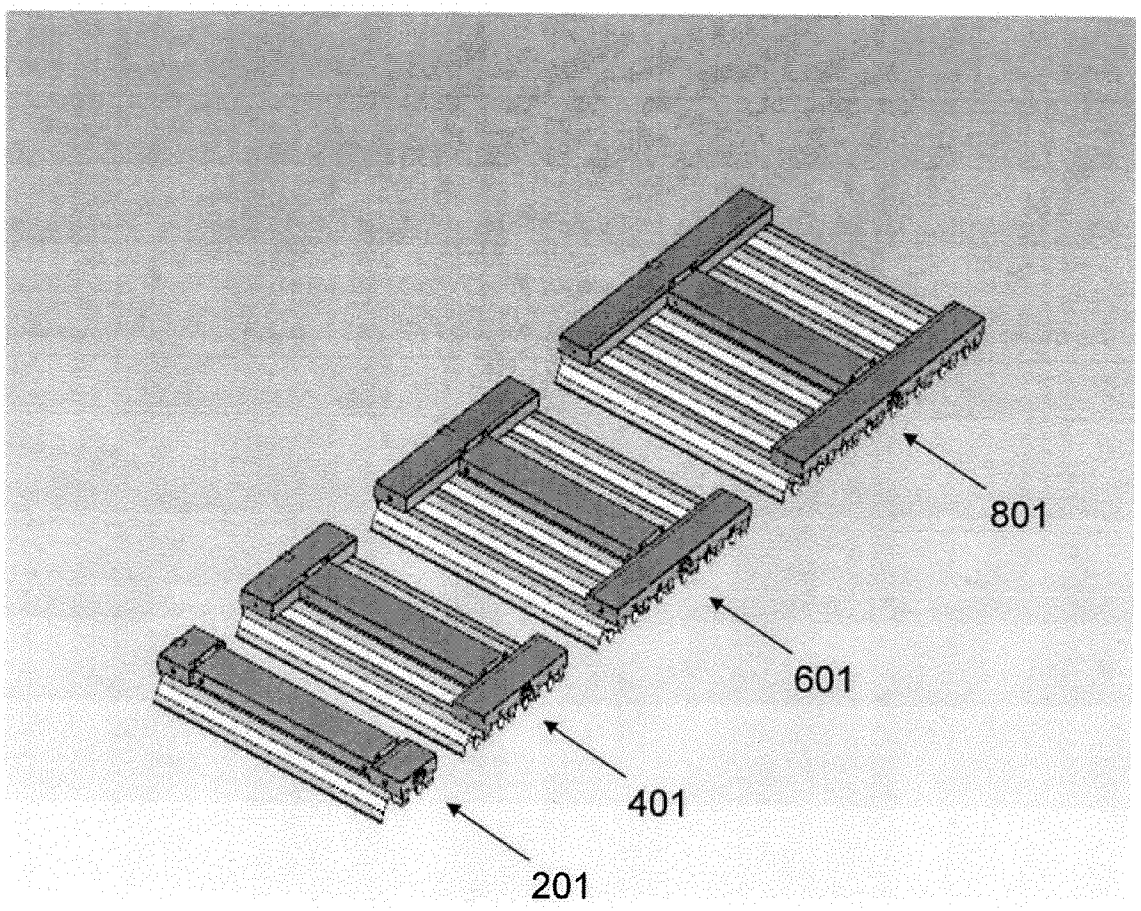
FIG. 5 depicts exemplary embodiments of the present invention configured to operate with different numbers of stick lights.

The width of the end sections changes with the number of lamps a fixture holds. FIG. 5 shows exemplary fixtures 201, 401, 601, and 801 adapted for use with two, four, six, and eight lamps, respectively. Other numbers of lamps, including a single lamp, are also possible. The width of the end sections may be about four to twelve inches per lamp.

The center section of the fixture establishes mechanical alignment of the end sections. The length of the center section in an embodiment is adapted to the length of the lamps to be used with the fixture. Common fluorescent tubes are nominally two feet, four feet, and eight feet long. In some embodiments, the center section is adjustable in length so that a given fixture can be configured for use with different length bulbs. An adjustable center section has two more or pieces that slide relative to each other in a telescoping fashion. Some embodiments include snaps or indents to set the center fixture section to a desired length.

Although described for fluorescent lighting, the present system may be used with other light sources, for example, LED or incandescent. Additionally, multiple types of light sources could be placed in one fixture.

Although certain exemplary embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A luminaire comprising:

one or more self-ballasted fluorescent lighting sticks, each lighting stick configured to secure and to pass electrical power to a replaceable fluorescent bulb, each lighting stick having an electrical-connecting end and a non-electrical-connecting end opposite the electrical connecting end, each lighting stick comprising:

a ballast circuit;

first electrical wiring configured to pass electrical power through both ends of the fluorescent bulb;

a first electrical connector at the electrical-connecting end and configured to pass electrical power to the first electrical wiring; and a frame configured to retain the fluorescent bulb, the ballast circuit, the first electrical wiring, and the first electrical connector; and a fixture base comprising:

an electrical end comprising a corresponding one or more second electrical connectors, each second electrical connector configured to mate with and pass electrical power to a respective said lighting stick through a respective said first electrical connector;

second electrical wiring configured to pass electrical power to the second electrical connectors; and a securing end opposite the electrical end and comprising a corresponding one or more non-electrical connectors, each non-electrical connector configured to secure the respective lighting stick to the fixture base at the non-electrical-connecting end of the lighting stick, wherein each of the lighting sticks is separately replaceable in the fixture base.

2. The luminaire of claim 1, wherein each of the lighting sticks further comprises a switch.

3. The luminaire of claim 1, wherein the fluorescent bulb is a T5 size.

4. The luminaire of claim 1, wherein the fixture base further comprises reflectors configured to reflect light produced by the lighting sticks.

5. The luminaire of claim 1, wherein the fixture base further comprises two end sections and a middle section.

6. The luminaire of claim 5, further comprising means for attaching the middle section to each of the two end sections.

7. The luminaire of claim 5, further comprising tabs and slots configured for mounting.

8. The luminaire of claim 5, wherein an electrical end section of the two end sections comprises the electrical end of the fixture base.

9. The luminaire of claim 8, wherein the second electrical wiring in the fixture base is entirely contained in the electrical end section.

10. The luminaire of claim 8, wherein another end section of the two end sections comprises a securing end section comprising the securing end of the fixture base.

11. The luminaire of claim 10, wherein the securing end section and the electrical end section have a similar size and shape.

12. The luminaire of claim 11, wherein the end sections have a width from about 4 inches to about 12 inches per lighting stick.

13. The luminaire of claim 5, wherein the middle section is adapted to have a length that corresponds to a length of the fluorescent bulb.

14. The luminaire of claim 13, wherein the fluorescent bulb has a length of 2 feet, 4 feet, or 8 feet.

15. The luminaire of claim 13, wherein the middle section is adjustable in length.

16. The luminaire of claim 10, wherein a number of lighting sticks is two, four, six, or eight.

17. The luminaire of claim 1, wherein the fixture base further comprises an International Electrotechnical Commission (IEC) 60320 connector for passing mains power to the second electrical wiring.

18. The luminaire of claim 17, wherein the fixture base further comprises another IEC 60320 connector configured for passing mains power to another luminaire.

19. The luminaire of claim 1, wherein the fixture base further comprises an International Electrotechnical Commission (IEC) 60320 connector configured for passing mains power for convenience powering.

20. A light fixture base configured to secure and pass electrical power to a separately replaceable self-ballasted fluorescent lighting stick, wherein the separately replaceable self-ballasted fluorescent lighting stick comprises a replaceable fluorescent bulb, a ballast circuit, first electrical wiring configured to pass electrical power through both ends of the fluorescent bulb, a first electrical connector at an electrical-connecting end of the lighting stick and configured to pass electrical power to the first electrical wiring, and a frame configured to retain the fluorescent bulb, the ballast circuit, the first electrical wiring, and the first electrical connector, and wherein the light fixture base comprises:

an electrical end section comprising:

a second electrical connector for mating with and passing electrical power to the first electrical connector of the lighting stick;

second electrical wiring configured to pass electrical power to the second electrical connector; and an International Electrotechnical Commission (IEC) 60320 electrical connector for passing mains power to the second electrical wiring;

a securing end section opposite the electrical end section and comprising a non-electrical connector configured to secure the lighting stick to the light fixture base at a non-electrical-connecting end of the lighting stick opposite the electrical-connecting end; and a middle section having a length that corresponds to a length of the fluorescent bulb, wherein the middle section is configured to establish mechanical alignment of the electrical end section and the securing end section.

21. The light fixture base of claim 20, wherein the light fixture base is configured to secure and pass electrical power to a plurality of self-ballasted fluorescent lighting sticks, and wherein the light fixture base is configured so that each of the plurality of lighting sticks is separately replaceable.

22. The light fixture base of claim 21, wherein each of the electrical end section and the securing end section have a similar width from about 4 inches to about 12 inches per each of the plurality of lighting sticks.

23. The light fixture base of claim 20, further comprising reflectors configured to reflect light produced by the lighting stick.

24. The light fixture base of claim 20, wherein the middle section, the electrical end section, and the securing end section are formed of sheet metal.

25. The light fixture base of claim 20, further comprising means for attaching the middle section to the electrical end section and to the securing end section.

26. The light fixture base of claim 25, wherein the attachment means comprises tabs and slots, wherein the middle section attaches to the electrical end section and to the securing end section in a snap-together manner.

27. The light fixture base of claim 20, wherein the middle section, the electrical end section, and the securing end section have a closed box shape.

28. The light fixture base of claim 20, further comprising tabs and slots configured for mounting.

29. The light fixture base of claim 20, wherein all electrical wiring is containing in the electrical end section.

30. The light fixture base of claim 20, wherein the securing end section comprises an open spring type clamp to secure the lighting stick.

31. The light fixture base of claim 20, wherein the securing end section and the electrical end section have a similar size and shape.

32. The light fixture base of claim 20, wherein the middle section is adjustable in length.

33. The light fixture base of claim 32, wherein the middle section comprises two pieces that slide relative to each other in a telescoping fashion.

34. The light fixture base of claim 33, wherein the middle section comprises snaps or indents to set the middle section to a desired length.

35. The light fixture base of claim 20, wherein the securing end section comprises another IEC 60320 connector configured for passing mains power to another light fixture base.

36. The light fixture base of claim 20, wherein the securing end section comprises another IEC 60320 connector configured for passing mains power for convenience powering.

37. The light fixture base of claim 20, wherein the light fixture base is configured to pass power of different voltages.

38. A self-ballasted fluorescent lighting stick, wherein the lighting stick is configured to secure and pass electrical power to a replaceable fluorescent bulb, wherein the fluorescent lighting stick is self-ballasted, wherein the self-ballasted fluorescent lighting stick has an electrical-connecting end and a non-electrical-connecting end opposite the electrical-connecting end, wherein the fluorescent lighting stick comprises:

a ballast circuit;

first electrical wiring configured to pass electrical power through both ends of the fluorescent bulb;

a first electrical connector at the electrical connecting end and configured to pass electrical power to the first electrical wiring; and a frame configured to retain the fluorescent bulb, the ballast circuit, the first electrical wiring, and the first electrical connector, wherein the fluorescent lighting stick is configured to be secured in and receive electrical power from a light fixture base, and wherein the light fixture base comprises:

an electrical end, comprising a second electrical connector for mating with and passing electrical power to the fluorescent lighting stick through the first electrical connector;

second electrical wiring configured to pass electrical power to the second electrical connector; and a securing end opposite the electrical end and comprising a non-electrical connector for securing the fluorescent lighting stick to the light fixture base at the non-electrical-connecting end of the fluorescent lighting stick.

39. The fluorescent lighting stick of claim 38, further comprising a switch.

* * * * *